United States Patent [19]

McKinney, III

[11] 4,421,282

[45] Dec. 20, 1983

[54] APPARATUS FOR FORMING AND PACKAGING MULTISTRAND ROVING

[75] Inventor: Charles D. McKinney, III, Anderson, S.C.

[73] Assignee: Owens-Corning Fiberglas Corporation, Toledo, Ohio

[21] Appl. No.: 477,596

[22] Filed: Mar. 28, 1983

Related U.S. Application Data

[63] Continuation of Ser. No. 287,011, Jul. 27, 1981, abandoned.

[51] Int. Cl.[3] ..... B65H 54/02; B65H 54/20

[52] U.S. Cl. ..... 242/18 G; 242/42; 242/43 R

[58] Field of Search ..... 242/18 G, 18 R, 35.5 R, 242/42, 43 R

[56] References Cited

U.S. PATENT DOCUMENTS 3,414,956 12/1968 Genson ..... 242/18 G 3,901,455 8/1975 Carlisle ..... 242/18 G 4,167,252 9/1979 Klink et al. ..... 242/18 G

*Primary Examiner*—Stanley N. Gilreath

*Attorney, Agent, or Firm*—Ronald C. Hudgens; Philip R. Cloutier; Greg Dziegielewski

[57] ABSTRACT

The disclosure embraces a method of and apparatus for processing fibers or filaments of glass or other fiber-forming material into a roving and winding the roving into a package. The disclosure includes a method and apparatus wherein a comb-like guide or shoe is engaged by a plurality of separated strands, the guide arranged to be moved downwardly from an uppermost position to a lowermost position toward a rotatable and reciprocable spiral wire traverse means, the traverse means converging the strands into a roving wound into a package. The strand guide or shoe is reciprocated laterally during a winding operation, the reciprocations of the strand guide being substantially in synchronism with the reciprocations of the spiral wire traverse means during package winding operations.

8 Claims, 7 Drawing Figures

APPARATUS FOR FORMING AND PACKAGING MULTISTRAND ROVING

This is a continuation of application Ser. No. 287,011, filed July 17, 1981, now abandoned.

TECHNICAL FIELD

This invention relates to a method of and apparatus for forming multistrand roving of filaments or fibers of glass or other fiber-forming material wherein streams of the glass or fiber-forming material are attenuated into fibers or filaments and wherein the fibers or filaments are separated or segregated into strands or linear groups and the strands or linear groups combined into a roving and the roving wound into a package.

BACKGROUND ART

Developments have been made in forming and packaging multistrand roving of glass fibers or filaments wherein fibers or filaments have been separated into strands by a comb-like guide or shoe and the separated strands engaged with a secondary comb-like guide or shoe to divert the strands through substantially ninety degrees and the strands converged into a roving and wound into a package. In such installation in which a spiral wire traverse member of the character shown in the U.S. Patent to Beach No. 2,391,870 is utilized in traversing the roving as it is wound into a package, several difficulties are encountered where the secondary guide or shoe is maintained in a relatively fixed position with respect to the winding collet and the traverse mechanism.

With a relatively fixed comb-like guide for the separated or split strands there is a reduction in the splitting efficiency which causes several problems. With a relatively stationary secondary guide or shoe the degree of the included angle of the fan-shaped group of strands approaching the spiral wire traverse member is very narrow. As the package increases in size, the degree of the angle of the group of strands does not change and the strands tend to pile up at the traverse member. This factor increases with the size of the package thereby restricting the size of the package that can be wound on a winding machine.

The product or roving on the inside region of the package may be over split and usually causes roving runability degration. The roving or product at the outer region of the package is usually under split and the coarse bundles impair the laminate appearance of the roving and the strength of the roving. In further processing the roving, there is usually a high level of fines from "slivers" off the course bundles which causes conformance problems in molding plastic materials wherein the roving is used as reinforcement in the plastic materials.

DISCLOSURE OF THE INVENTION

The present invention involves a method of and apparatus for attenuating streams of glass or other fiber-forming material into fibers or filaments wherein the method and apparatus include a first or primary comb-like guide or shoe for segregating, separating or splitting a fan-like group of attenuated fibers or filaments into a plurality of strands or linear groups, engaging the separated or split strands with a secondary comb-like guide or shoe which is movable to different positions along the strand line, the secondary guide diverting the strands through substantially ninety degrees, converging the strands into a roving by a spiral wire traverse means and winding the roving into a package.

The method involves varying the position of the secondary guide or shoe as the package of roving increases in size, the secondary guide being progressively moved downwardly toward the spiral wire traverse means as the package increases in size so that the included angle of the fan formation of strands as the strands approach the spiral wire strand traverse means increases by reason of the secondary guide moving closer to the spiral wire traverse means.

Several advantages are attained through the use of a variable position multiple strand guide means or shoe. As the package of roving increases in size, the angularity of the fan formation of split strands is increased and the strands of the roving engaging the spiral wire traverse do not tend to pile up on the spiral wire traverse which condition permits winding of larger packages containing more roving in each package. The piling up of strands on the spiral wire traverse reduces the splits.

Furthermore, the increased angularity of the fan formation of strands at the region of their engagement with the spiral wire traverse compensates in a measure for the change in tension or "bite" on the spiral wire traverse. By varying the position of the secondary shoe toward the spiral wire traverse as the package increases in size, the splitting efficiency is improved and more even tension maintained in the strands at the spiral wire traverse.

Thus the size of the package may be increased and the splitting efficiency improved by the variable positioning of the secondary shoe or guide toward the spiral wire traverse. The secondary guide or shoe is programmed for lateral reciprocatory movement corresponding to the reciprocatory movement of the spiral wire traverse lengthwise of the package to improve the winding of the roving into a package and to maintain substantially uniform tension in the strands of the roving during the winding operation.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawings.

BRIEF DESCRIPTION OF THE DRAWINGS

The details of the invention will be described in connection with the accompanying drawings in which.

BEST MODE FOR CARRYING OUT THE INVENTION

While the method and apparatus of the invention are particularly usable for processing fibers or filaments of heat-softened mineral material, such as glass, and producing multistrand roving of the filaments or fibers and packaging the roving, it is to be understood that the method and apparatus may be utilized for forming and packaging a roving of filaments or fibers of other filament or fiber-forming materials.

Figure 1:
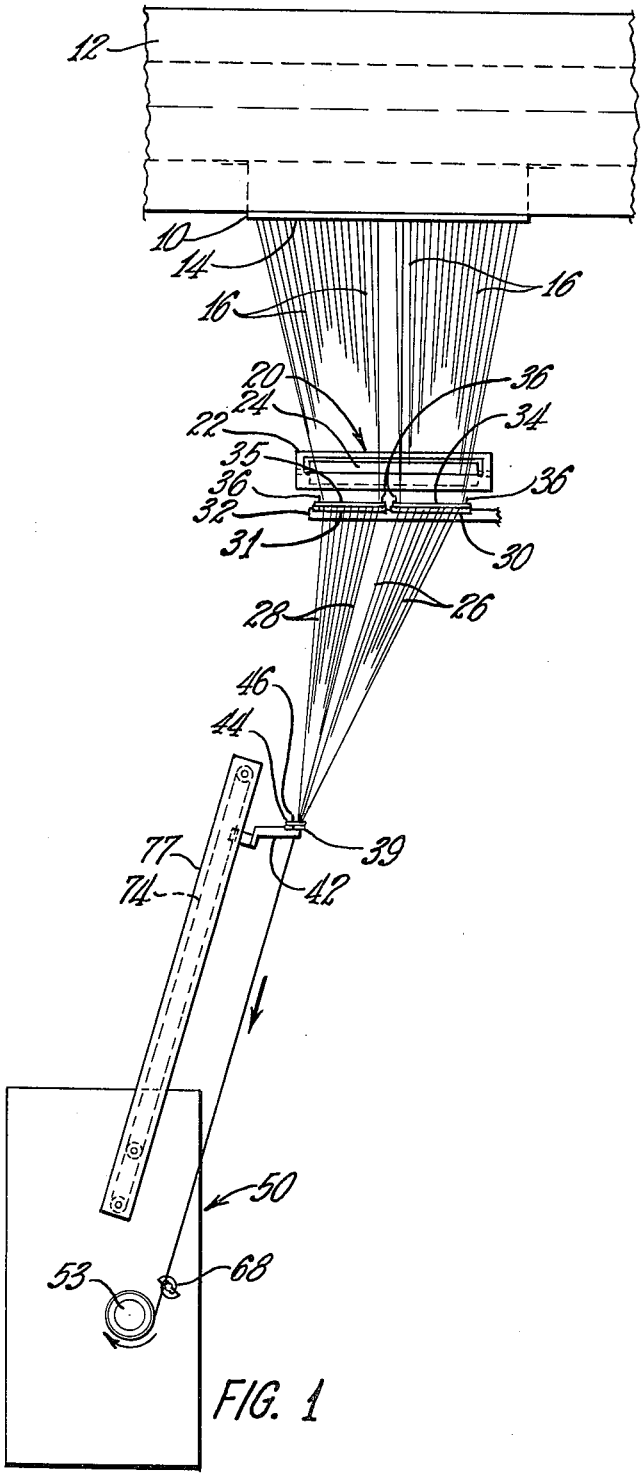
FIG. 1 is a front elevational view of an apparatus for carrying out the method of forming and packaging multistrand roving of strands of glass filaments or other fiber-forming material, the figure illustrating a variable position guide or shoe for the split strands.

Referring to FIG. 1 of the drawings there is illustrated a bushing or stream feeder 10 containing a supply of heat-softened glass or other filament-forming material. Where the filament-forming material is glass, the feeder 10 may be secured to a forehearth 12 supplied with softened glass from a furnace (not shown).

Pieces of glass may be reduced to molten condition in a melter or other means connected with the stream feeder. The feeder or bushing 10 is connected with a source of electric energy for supplying heat to the material in the feeder or bushing to maintain the material at a proper temperature and viscosity for forming fibers or filaments.

The floor section 14 of the feeder is provided with a large number of orifices for flowing streams of the glass or other fiber-forming material from the feeder. The glass streams are attenuated into individual filaments or fibers 16 by winding a roving of strands of the filaments or fibers into a package as hereinafter described.

The filaments 16 are advanced into engagement with an applicator 20 for applying size or coating material onto the filaments. The applicator may comprise a housing 22 in which is rotatably mounted an applicator roll 24 immersed in size or coating material in the housing 22 for transferring the size or coating material onto the filaments through wiping action of the filaments engaging a film of the sizing or coating material on the applicator roll or member 24.

In the embodiment illustrated in FIG. 1, the filaments 16 at a region below and adjacent the applicator 20 are segregated or separated into two groups of strands designated 26 and 28. Each group of strands is engaged by a spiral traverse member forming a roving at the region of winding, and each roving is wound into a separate package on a collet of a winding machine.

In the embodiment illustrated, the filaments are divided by primary guides or shoes 30 and 31 into the grpoups of strands 26 and 28. The primary guides or shoes 30 and 31 are removably supported on a support member 32 and each guide is provided with spaced teeth or projections, the spaces accommodating the split or separated strands 26 and 28 of two groups.

The two groups of split strands are maintained in the spaces or grooves of the primary guides or shoes by removable retainer bars 34 and 35, the bars 34 and 35 being removably mounted on pins 36 carried by the support 32. The guides or shoes 30 and 31 are of comb-like construction whereby the projections separate and segregate the strands into the spaces or grooves between the projections on the guides or shoes. It is conventional practice to separate filaments into split strands as is shown in Klink et al U.S. Pat. No. 3,371,877.

Figure 2:
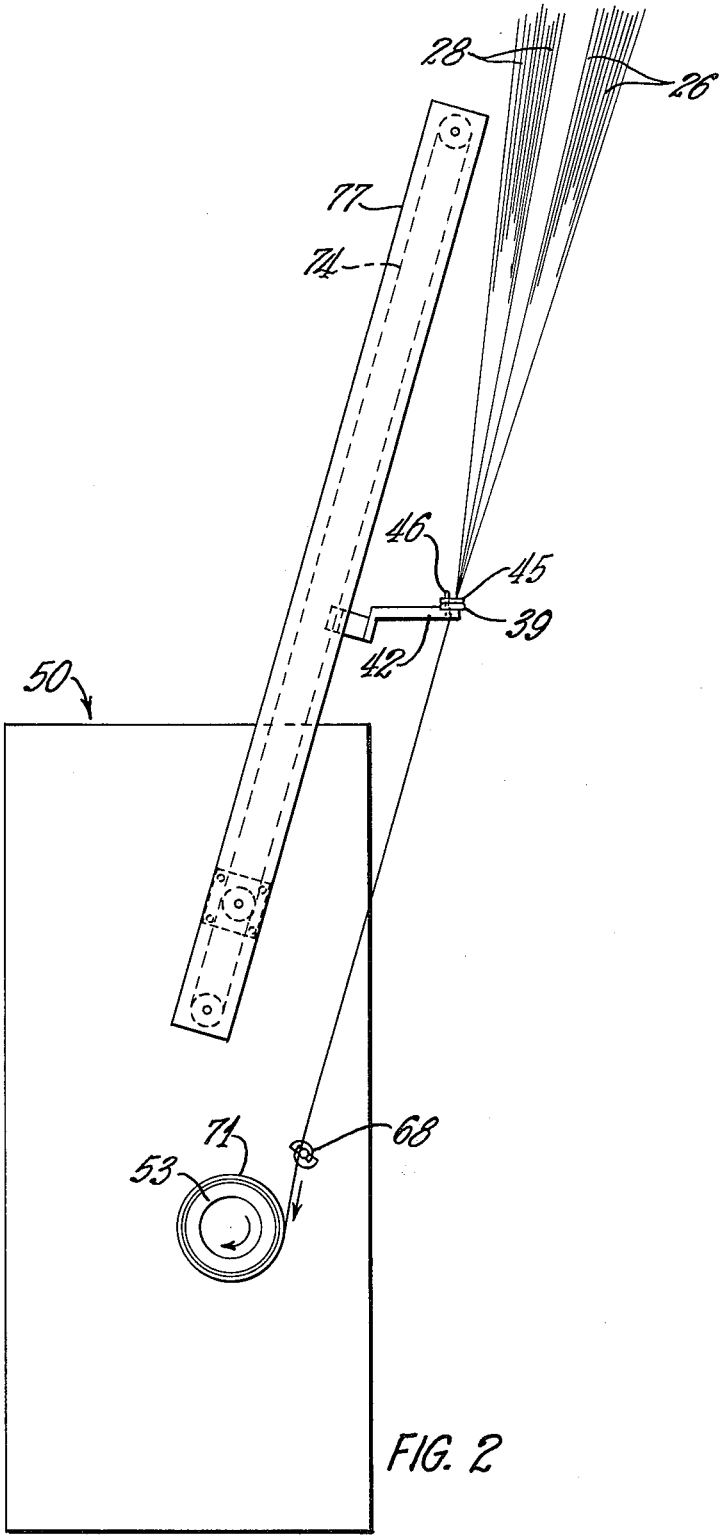
FIG. 2 is an enlarged front elevational view of the package winder and the variable position guide or shoe for the strands and means for moving the guide to several positions.
Figure 3:
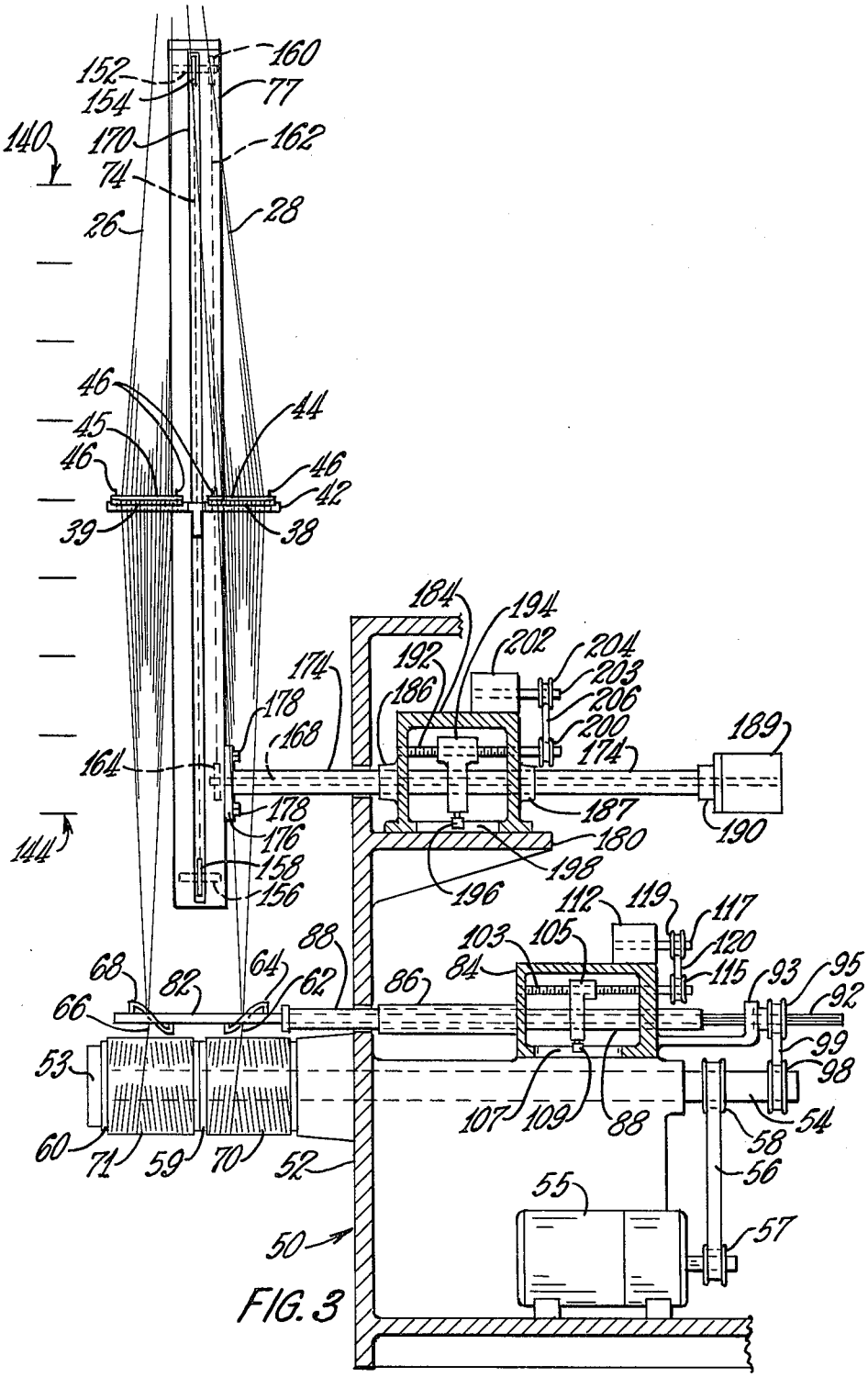
FIG. 3 is a side elevational view of the package winder partly in section and the variable position strand guide and components for driving and controlling the traverse mechanism and the variable position strand guide means.

The groups of strands 26 and 28 in their downward movement are engaged with secondary guides or shoes 38 and 39, shown in FIGS. 1, 2 and 3, which are substantially the same as the primary guides or shoes. The guides or comb-like shoes 38 and 39 are removably supported upon a carrier or movable member 42 and are held on the carrier member by means of retainer bars 44 and 45 removably mounted on pins 46 secured to the support 42.

The secondary shoes 38 and 39 are provided with spaced projections so that the split strands of the groups of strands 26 and 28 are engaged in the grooves or spaces in the secondary shoes 38 and 39. It should be noted from a comparison of FIGS. 1 and 3 that the guides 38 and 39 divert the groups of strands 26 and 28 through ninety degrees.

The comb-like secondary guides 38 and 39 are also removable so as to enable the operator to thread the split strands of the groups of strands 26 and 28 into the spaces or grooves in the guides or shoes 38 and 39, the bars 44 and 45 maintaining the strands in the spaces or grooves.

The operation of the variable position member or carrier 42 on which the secondary guides or shoes 38 and 39 are supported and the winding machine on which the rovings are wound into packages and the control components will now be described.

Referring to FIGS. 1, 2 and 3, the apparatus includes a winding machine 50 having a housing 52 upon which is journally supported a winding collet or rotating collector 53 mounted upon a shaft 54 rotatably supported in bearings in the winding machine housing.

The winding collect 53 and shaft 54 are rotated by an electrically energizable motor 55 means of a belt 56 engaging a pulley 57 on the motor shaft and a pulley 58 on the shaft 54, the motor being controlled by conventional timer-switch means (not shown). In the embodiment illustrated the winding collet is of a dimension to accommodate two thin-walled plastic sleeves or tubes referred to as forming tubes 59 and 60, the forming tubes 59 and 60 being telescoped onto the collet 53 in end-to-end relation.

The group of strands 28 is converted into a roving 62 by a spiral wire traverse member 64, and the group of strands 26 is converged into a roving 66 by a second spiral wire traverse member 68. The spiral wire traverse members are of the character shown in the U.S. Pat. to Beach No. 2,391,870. In this manner the roving 62 is wound into a package 70 and the roving 66 wound into a package 71 on each of the forming tubes 59 and 60 mounted on and rotated by the single collet 53.

The carrier 42 supporting the secondary strand guides 38 and 39 is secured to a movable means or member such as an endless chain 74 contained within a hollow or tubular member or support 77. The carrier 42 is movable downwardly toward the spiral wire traverse members to variable positions by the endless chain mounted within the tubular member 77. The tubular member 77, the carrier member 42 and the guide shoes 38 and 39 are reciprocated laterally in order to preserve proper alignment between the movable shoes 38 and 39 and the reciprocations of the spiral wire traverse members 64 and 68.

The carrier or movable member 42 mounting the secondary strand guides 38 and 39 is movable substantially in a vertical direction an the central axis of the general movement of the strands 26 and 28 between the primary shoes 30 and 31 and the traverse members 64 and 68.

The tubular member or support 77 is substantially parallel to the central axis of movement of the groups of strands 26 and 28 from the primary shoes 30 and 31 and the spiral wire traverse members 64 and 68. The carrier 42 and the variably positioned shoes 38 and 39 during a winding operation move along the tubular member 77 from an uppermost position illustrated in FIG. 1 to a lowermost position illustrated in FIG. 5.

Figure 5:
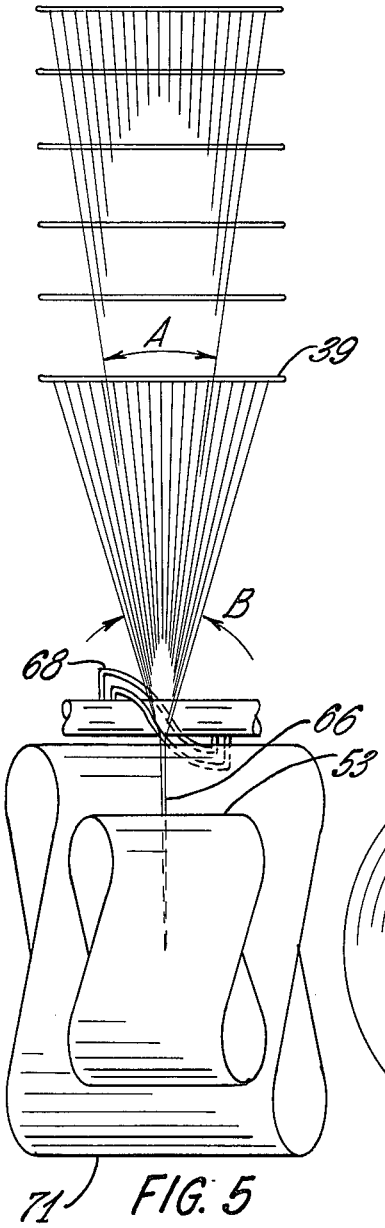
FIG. 5 is a schematic side elevational view illustrating the differences in angularity of the fan of filaments engaging the spiral wire traverse in two different positions of the strand guide and illustrating the comparative sizes of the packages of roving as the package size increases.

In the start of winding packages on forming tubes 59 and 60 mounted on the collet 53, the secondary guides 38 and 39 are at their uppermost position, shown in FIG. 1, whereby the included angle of each fan of strands is comparatively small, the included angle "A" with the guides 38 and 39 in an intermediate position being illustrated in FIG. 5.

During winding of the packages, the guide carrier member 42 is moved downwardly preferably by successive increments so that as the packages become larger, each group of strands is moving at an increasing included angle illustrated at "B" in FIG. 5 so that the strands of each group engage more of the spiral wire traverse as illustrated in FIG. 5 to attain the advantages of the invention. In FIG. 3 an intermediate position of the secondary guide members or shoes 38 and 39 is illustrated in which position approximately one half of each normal package has been formed.

It is essential that the central axis of each group of strands engaged by the secondary shoes 38 and 39 be properly coordinated with traversing movements of the spiral wire traverse members 64 and 68 so as to obtain properly wound packages of the roving. Thus, as the secondary shoes 38 and 39 guide the strands toward the traverse members 64 and 68, the member 77 mounting the endless chain 74 is reciprocated laterally in coordination with the reciprocation of the spiral wire traverse members 64 and 68 driven by means hereinafter described.

As the packages increase in size, the secondary shoes 38 and 39 and the supporting member 42 are moved downwardly from the uppermost position shown in FIG. 1 by successive increments so that as the secondary shoes 38 and 39 approach a lower of several positions the included angle "A" of a group of strands indicated in FIG. 5 is proportionately increased as indicated by angle "B" of the fan-like group of strands in closer proximity to the spiral wire traverse member.

Figure 6:
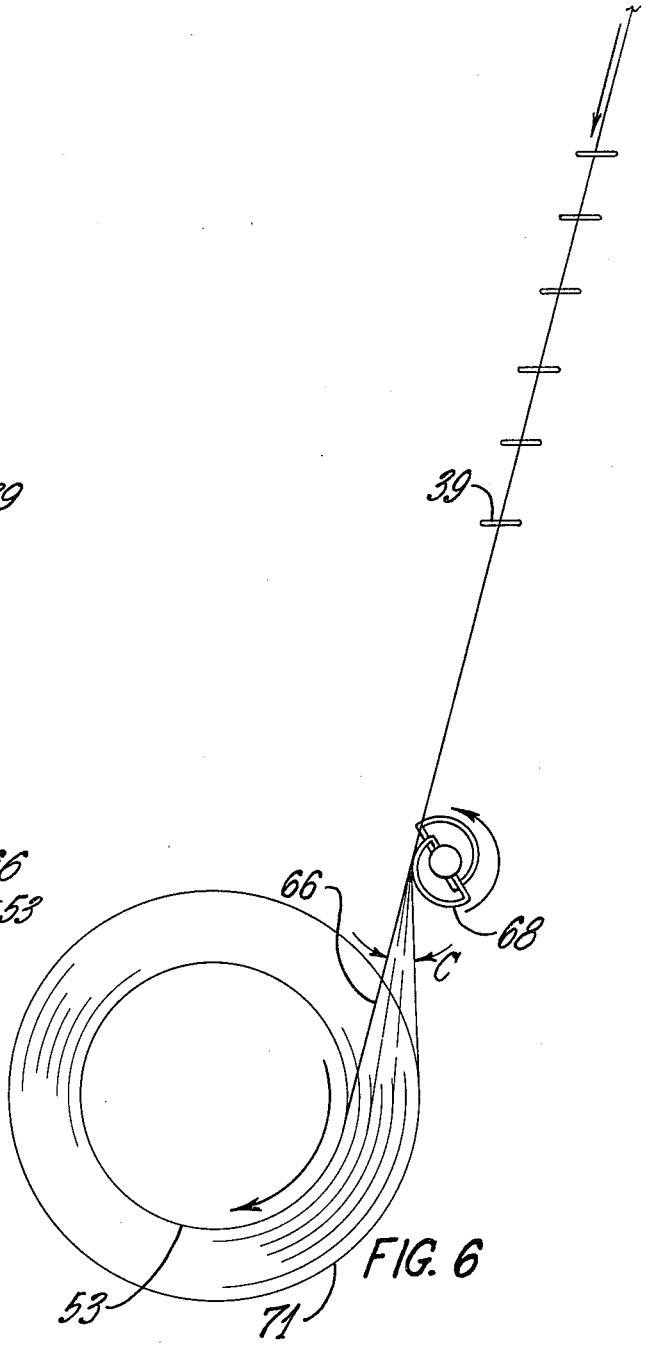
FIG. 6 is a front view of the schematic illustration of FIG. 5.

FIG. 6 illustrates the increasing angle designated "C" of the roving which occurs between a spiral wire traverse and the periphery of a package as the package increases in size. At the start of winding of a package, the roving 66 is in substantial alignment with the central axis of the fan of strands approaching the traverse. As winding continues and the package increases in size, the angle "C" between the engagement of the strands with the spiral wire traverse and the periphery of the package increases in size as illustrated in FIG. 6.

The increased angularity indicated at "B" in FIG. 5 of the fan formation of strands at the region of their engagement with a spiral view traverse compensates in a measure for the changes in the tension or "bite" of the strands on the spiral wire traverse by the increase in angle "C".

The control means for driving the endless chain 74 and reciprocating the secondary shoes 38 and 39 will be hereinafter described.

Means is illustrated in FIG. 3 for rotating and reciprocating the spiral wire traverse members 64 and 68. The spiral wire traverse members 64 and 68 are fixedly mounted upon a shaft 82 which is both rotatable and reciprocable for distributing the rovings 62 and 66 lengthwise of the packages 70 and 71. Secured to the housing 52 of the winding machine 50 is a smaller supplemental or auxiliary housing 84.

Secured to or integral with the left-hand end region of the housing 84 is a sleeve-like member 86 through which extends an inner sleeve or tubular member 88, the latter extending in a left-hand direction through an opening in a wall of the housing 50. The sleeve-like member 86 provides a bearing for the sleeve member 88 so that the inner sleeve member 88 is slidable with respect to the bearing member 86.

The sleeve-like member 88 extends through openings in the housing 84. The traverse shaft 82 is rotatable within the sleeve member 88. The right-hand end region of the traverse shaft 82 is splined as shown in 92, the splined portion of the shaft extending through a bearing in member 93 extending from the auxiliary housing 84.

The splined region 92 of the traverse shaft 88 accommodates a pulley or sheave 95. The pulley or sheave 95 is arranged to rotate the traverse shaft 82 and has an interiorly splined portion engaging the splined region 92 whereby the splined region 92 of the traverse shaft 82 is slidable in the pulley 95 but the pulley is rotated with the shaft 82 by reason of the splined connection.

The shaft 54 mounting the collet 53 is provided with a pulley or sheave 98 connected to the pulley or sheave 95 by a belt 99 whereby the traverse shaft 82 is rotated by the motor 55.

Means is provided in the supplemental housing 84 for reciprocating the traverse shaft 82 to distribute the rovings lengthwise of the packages. The sleeve 88 is provided with retaining rings (not shown) engaging the traverse shaft 82 whereby the traverse shaft is reciprocated lengthwise within the sleeve 88 but the sleeve is not rotatable.

Disposed in the housing 84 is a threaded member or shaft 103 journally supported in the walls of the housing 84. Threadedly mounted upon the threaded member 103 is a cam follower or member 105. The member 105 is fixedly secured to the sleeve 88 so that movement of the follower 105 will move the sleeve 88 and the traverse shaft 82 lengthwise depending upon rotation of rotation of the threaded member or shaft 103.

The member 105 is provided with a projection or roller 107 which extends into a slot 109 in the floor of the auxiliary housing 84. The slot 109 has walls parallel with the axes of the sleeve 88 and the threaded member 103.

The walls of the slot 109 are engaged by the projection or roller 107 to prevent rotation of the member 105. In this manner rotation of the threaded shaft or member 103 moves the sleeve 88 and the traverse shaft 82 lengthwise so that the traverse members 64 and 68 distribute the rovings lengthwise of the packages 70 and 71.

The threaded member 103 is rotated by a reversible synchronous motor 112 usually referred to as a slo-syn motor mounted upon the housing 84. A projecting end region of the threaded shaft 103 is provided with a pulley 115 and the shaft 117 of the synchronous motor 112 is equipped with a pulley 119, the pulleys being connected by a belt 120.

Figure 4:
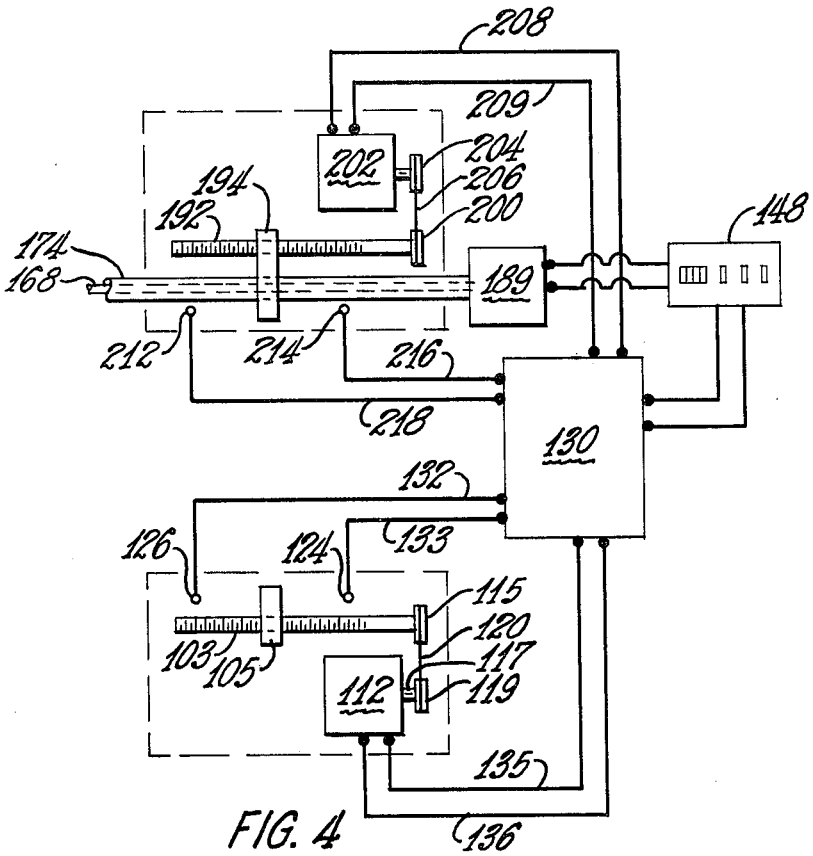
FIG. 4 is a schematic view of operative components for the traverse means and the variable position strand guide and control circuits for the components.

With particular reference to the circuitry shown in FIG. 4, the circuit is inclusive of terminals or probes 124 and 126, these probes or terminals being disposed to be alternately engaged by the follower or member 105 to effect reversal of the motor 112 to reciprocate the traverse shaft 82 and the spiral wire traverse members 64 and 68.

The terminals or probes 124 and 126 transmit signals to a control system or instrumentation contained in a control panel 130 illustrated schematically in FIG. 4. The terminals or probes 124 and 126 are connected with the control panel by conductors 132 and 133 and the motor 112 is connected with the control panel by conductors 135 and 136.

FIG. 3 shows the mechanism for laterally moving or reciprocating the tubular support 77, the guide mounting support 42, and the secondary guides or shoes 38 and 39 in substantial synchronism with the reciprocatory movements of the traverse shaft 82 and the spiral wire traverse members 64 and 68.

FIG. 3 also shows the means or arrangement for moving or driving the endless chain 74 to move the secondary guides or shoes 38 and 39 from a starting position at the start of winding roving into packages, the chain being moved at successive intervals to positions having the secondary shoes 38 and 39 downwardly as the packages increase in size and diameter.

In FIG. 3 the uppermost position of the secondary shoes 38 and 39 is indicated by the uppermost horizontal line or indexed position 140, and the lowermost position of the secondary shoes 38 and 39 when the packages are nearing completion being indicated by the lowermost horizontal line or indexed position 144.

In FIG. 3 the intermediate positions indicated by the several horizontal lines represent successive increments in movement downwardly of the secondary shoes 38 and 39, and such index positions are "dwell" positions to which the shoes are moved successively and remain for a period of time in each of the several "dwell" positions from the start of winding of the packages to the completion of the packages.

Each of the successive index lines indicates the "dwell" times at which the shoes 38 and 39 are maintained in one position during package winding, and each "dwell" position of winding may be for a duration of two to five minutes or more depending on the sizes of the packages to be produced.

The chain 74 is actuated at the expiration of each "dwell" time period to move the shoes to the next succeeding lower "dwell" position. The index lines on FIG. 3 indicate nine "dwell" positions, and FIG. 4A is a schematic graph illustrating the "dwell" times between the uppermost position 140 and the lowermost position 144 of the secondary guides.

Figure 4A:
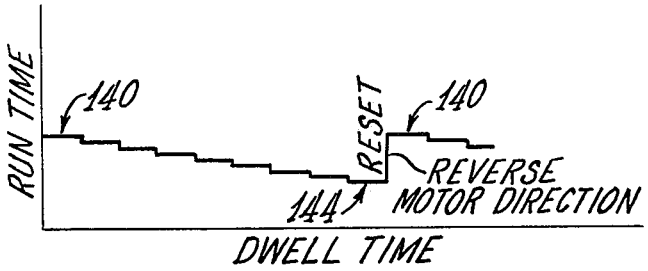
FIG. 4A is a schematic diagram illustrating the timing of movement of the variable position strand guide.

The graph, FIG. 4A, also indicates by offset lines the "dwell" times which are much longer times than the periods of movement of the shoes between successive "run" times. The long lines on the graph indicate "run" times of motor 189 and are of the short duration of time required to move the secondary shoes 38 and 39 by the chain 74 from one position to a second position which time may be one second or slightly more. The periods of "run" times and "dwell" times are controlled by a conventional programmer indicated schematically at 148 in FIG. 4.

The mechanism for controlling the lateral reciprocation of the shoes 38 and 39, support 42, tubular member 77 enclosing the chain 74, and the means for moving the endless chain 74 are shown in FIG. 3. The mechanism includes a shaft or pin 152 journaled in the upper end region of the tubular support member 77 on which is mounted a first sprocket 154 engaged by the chain 74. Journaled at the lower end region of the tubular member 77 is a shaft or pin 156 on which is mounted a second sprocket 158 engaged by the chain 74.

As previously mentioned the carrier or member 42 carrying the secondary shoes 38 and 39 is secured to the chain and during winding of packages the member 42 is progressively moved from its uppermost position as indicated by the index line 140 in FIG. 3 toward the lowermost position indicated by the lowermost index line 144.

Also mounted on the shaft or pin 152 is a third sprocket 160 which is connected by an endless chain 162 with a fourth sprocket 164, the fourth sprocket being securely mounted on an end of a horizontal shaft 168. The wall of the tubular member or support 77 is provided with a lengthwise arranged slot 170 which is parallel with the lengthwise path of movement of the chain 74. The slot 170 accommodates the support member 42 which is secured to the chain 74, the slot permitting movement of the support 42 and the secondary shoes 38 and 39 lengthwise of the tubular support 77.

The shaft 168 is rotatably mounted within a horizontally-arranged tubular support member 174 shown in FIG. 3. The left end of the tubular support member 174 is provided with a flange or flange plate 176 which is fixedly secured to the tubular support member 174 by means of securing bolts 178 or other securing means.

Mounted upon a portion or ledge 180 of the winding machine housing 52 is a second auxiliary or supplemental housing 184 enclosing means for reciprocating the shaft 168 and the tubular support member 174. End walls of the supplemental housing 184 are provided with bearing means or bosses 186 and 187 in which the tubular member 174 is reciprocable but is nonrotatable.

Secured to the right end of the tubular support member 174 is an electrically energizble synchronous reversible motor 189. The motor housing has a boss portion 190 fixedly secured to the right end of the tubular member 174.

The synchronous motor 189 rotates the shaft 168 which drives the sprocket 164 and chain 162 to drive the chain 74 downwardly at successive intervals, the motor 189 being reversible so that at the completion of the packages, the chain 74 may be driven in a reverse direction to move the support 42 and the secondary shoes 38 and 39 at a comparatively rapid rate to their uppermost position at the index line 140 preparatory to starting the winding of packages.

Means is provided in the supplemental housing 184 for reciprocating the member 174, the support tube 77, the chain and sprocket arrangement carried thereby and the secondary strand guides or shoes 38 and 39 so that the guides are reciprocated substantially in synchronism with the reciprocations of the traverse shaft 82 and the spiral wire traverse members 64 and 68.

Rotatably supported in bearings in the walls of the supplemental or auxiliary housing 184 is a threaded shaft or member 192 on which is threadedly mounted a follower or member 194. The follower or member 194 is provided with a projection or roller 196 extending into a slot 198 formed in the floor of the auxiliary housing 184, the shaft 192 and the slot 198 being in parallelism with the member or tube 174.

The follower or member 194 is secured to the tube 174 so that lengthwise movement in either direction of the follower 194 by rotation of the threaded shaft 192 moves or reciprocates the tube or sleeve 174, the support tube 77, the chain 74, and the secondary shoes 38 and 39 laterally.

One end of the threaded shaft 192 extending from the auxiliary or supplemental housing 184 is provided with a pulley or sheave 200. A reversible synchronous motor 202 is supported upon the supplemental housing 184. The shaft 203 of the motor 202 is provided with a sheave or pulley 204. A connecting belt 206 engages the pulleys 200 and 204 whereby the motor 202 rotates the shaft 192 to reciprocate the follower or member 194 to laterally reciprocate the support 174, motor 189, shaft 168, the vertically disposed support 77 and the secondary shoes 38 and 39 during package winding operations.

Referring to FIG. 4, the synchronous motor 202 is connected by conductors 208 and 209 with the control system or instrumentation in the panel 130. The direction of rotation of the synchronous motor 202 is controlled by probes or terminals 212 and 214 connected by conductors 216 and 218 with the control system or panel 130, the terminals or probes 212 and 214 being respectively engaged at limits of movement of the member or follower 194 to transmit signals to the instrumentation in the control panel 130.

The operations of the motors 112, 189 and 202 are controlled by instrumentation in the panel 130 programmed by a programmer 148. The programmer 148 may be programmed to determine the length of time that the motor 55 operates in winding complete packages from initial starting to completion. The programmer 148 also controls the periodic actuation of the motor 189 to index or move the secondary shoes 38 and 39 from one dwell position to the next succeeding dwell position.

The programmer 148 also contains timing means for determining the length of "dwell" times for the secondary shoes 38 and 39 and actuates the motor 189 to successively move the secondary guides 38 and 39 from one index position to the next index position and at the completion of the packages the programmer reverses the direction of rotation of the motor 189 to return the strand guides 38 and 39 from their lowermost position indicated by the index line 144 in FIG. 3 to an uppermost position indicated by the index line 140 in preparation for a next cycle of winding packages and stops rotation of collet drive motor 55.

The motor 202 starts with the follower 194 in its right-hand position for reciprocating the secondary guides 38 and 39 and associated mechanism in synchronization with the motor 112 which simultaneously is started to move the follower 105 controlling the reciprocation of the traverse members 64 and 68 from a right-hand position of the follower.

Theoretically, the motors 112 and 202 move in synchronism. In event that there is a slight asynchronous operation or condition between the running of the motors 112 and 202, the controller 130 functions to cause the motor 202 rotating to move the follower 194 to the right-hand position to reach the right-hand position in advance of the movement of the follower 105 reciprocating the traverse members 64 and 68 to their right-hand position.

The control instrumentation of the control panel 130 causes the motor 202 to dwell momentarily until the traverse member drive motor 112 moves the follower 105 to its extreme right-hand limit of movement. The instrumentation in the control panel 130 then actuates both motors 202 and 112 to move the followers 105 and 194 in synchronous relation until they are again in asynchronous or out-of-synchronous relation which condition is corrected in the described manner.

The apparatus for carrying out the method operates and functions as follows: Assuming that two packages of roving of glass filaments are to be wound on the collet 53, the glass streams flowing from orifices in the floor 14 of the stream feeder 10 are brought down by an operator and the filaments 16 engaged by a hand-held guide (not shown) by the operator and separated into the two groups of strands 26 and 28.

The operator then engages the projections on the guides 30 and 31 with the respective groups of strands and replaces the guides 30 and 31 on the support 32, shown in FIG. 1, and places the retaining bars 34 and 35 over the strands to maintain the strands in the spaces or grooves defined by several projections on the primary guides or shoes 30 and 31.

The operator then removes the secondary guides or shoes 38 and 39 from the support or carrier 42 and engages the strands 28 of one group with the spaces between projections on the secondary guide 38 and replaces the guide on the carrier 42 and places the retaining bar 44 over the strands to maintain them in the secondary guide 38.

The operator repeats the same operation with the group of strands 26 to engage them with the secondary guide 39. The engagement of the strands 26 and 28 with the guides 39 and 38 as shown in FIG. 3 are at an angle of ninety degrees with respect to the plane of the groups of strands 26 and 28 above the primary guides or shoes 30 and 31 shown in FIG. 1.

The operator then engages the respective groups of strands with the traverse members 64 and 68 and manually initiates winding a few turns of each roving 62 and 66 on the respective forming tubes 59 and 60 mounted on the collet 53. If desired, the two groups of strands may be initially advanced by conventional standby rolls (not shown) and a few turns of the rovings then manually wound upon the forming tubes prior to initiating rotation of the collet 53 by energizing the motor 55 through the programmer.

At the start of winding operations, the secondary guides or shoes 38 and 39 are in the uppermost position approximately at the index line 140 in FIG. 3. The follower or member 105 and the follower or member 194 are in their extreme right-hand positions as viewed in FIG. 3.

The motor 55 is energized by switch means associated with the control panel 130 controlled by the programmer 148. The programmer also energizes the synchronous motor 112 to initiate reciprocation and rotation of the traverse shaft 82 and the spiral wire traverse members 64 and 68. Simultaneously the programmer initiates energization of the synchronous motor 202 for reciprocating the tubular member 174, the vertical support tubular member 77 and the secondary guides or shoes 38 and 39.

The synchronous motors 112 and 202 are adapted to reciprocate the spiral wire traverse members 64 and 68 in synchronism with the secondary guides or shoes 38 and 39 as winding of the rovings 62 and 66 progresses. Winding the roving into packages progresses for the selected number of minutes, for example five minutes, a period of "dwell" time without any rotation of the motor 189 or downward movement of the secondary shoes 38 and 39.

The programmer, after the lapse of the selected number of minutes, initiates rotation of the motor 189 to rotate the shaft 168 and the chain 162 which drives the chain 74 moving the secondary guides a distance between the uppermost index line 140 and the next succeeding index line. This operation of the motor 189 may be for one second or slightly more. In this manner the guides or shoes 38 and 39 are moved downwardly a distance equal to the position of the next lowest index line below the index line 140.

Winding continues without interruption of rotation of the collet and packages carried thereby and the synchronous motors 112 and 202 continue without interruption to reciprocate the spiral wire traverse members 64 and 68 and the secondary shoes 38 and 39 in synchronism so that the rovings are uniformly distributed lengthwise of the packages.

As hereinbefore mentioned, in the event of an asynchronous condition between the reciprocation of the traverse members and the lateral reciprocation of the secondary guides or shoes 38 and 39, the follower 194 reaches its maximum right-hand position in advance of the follower 105 reaching such a position and rotation of the motor 202 is momentarily interrupted by the programmer until the follower 105 reaches its extreme right-hand position after which the programmer again energizes both synchronous motors 112 and 202 to move the followers 105 and 194 in synchronism.

At intervals several minutes each, the timer of the programmer causes the energization of the motor 189 to move the secondary shoes 38 and 39 a successive distance downwardly at each interval until the secondary shoes 38 and 39 reach the lowermost or index position of 144 at which time the packages are completed and with nine "run" times of five minutes each the packages would be completed in approximately forty-five minutes.

The programmer then interrupts the collet drive motor 55 and the synchronous motors 112 and 202. At the same time the motor 189 is energized by the programmer to rotate in a reverse direction which reverses direction of movement of the chain 74 and moves the secondary shoes from the lowermost position indicated by the index line 144 to the uppermost position indicated by index line 140 preparatory to winding subsequent packages.

The operator then severs the rovings 62 and 66 and slidably removes the collected packages 70 and 71 from the winding collet 53. The operator then places empty forming tubes onto the collet 53 and initiates winding of the roving on the empty forming tubes and the above sequence of actions and operations repeated in winding new packages of roving by the programmer 148.

As previously mentioned herein, the angle "A" shown in FIG. 5 of a group of strands is very narrow at the start of winding operations with the secondary guides or shoes 38 and 39 in their uppermost position and as they are moved successively downwardly and the secondary guides approach the traverse members 64 and 68 the included angle "B" of the fan of strands increases and hence the strands of a group are compacted into a roving by the spiral wire traverse to secure the advantages hereinbefore mentioned.

The invention enables the formation of compact packages of roving with more glass in a package and the increased angularities of the fan formation of the strands at the region of their engagement with the spiral wire traverse compensates for the change in tension or "bite" on the spiral wire traverse as the package enlarges in size.

Furthermore the splitting efficiency is improved and more even tension exists in the strands at the region of the spiral wire traverse members. Additionally, there is a reduction of fines from "slivers" and hence the runability of the roving is improved and the reinforcement factor of the roving in molded plastics is greatly improved. By reason of the compaction of the strands of the roving by the spiral wire traverse members, satisfactory packages of increased size may be wound thereby reducing the cost of producing and processing the roving.

It is apparent that, within the scope of the invention, modifications and different arrangements may be made other than as herein disclosed, and the present disclosure is illustrative merely, the invention comprehending all variations thereof.

I claim:

1. Apparatus for packaging a roving comprised of a plurality of strands of fibers comprising, a primary strand guide having means separating the strands and maintaining the strands in spaced relation, a secondary strand guide engaging the strands below the primary guide, a winding apparatus including a rotating collector upon which the roving is wound into a package, an elongated support member arranged in substantial parallelism with the axis of movement of the strands toward the rotating collector, relatively movable means mounted by the elongated support member connected with the secondary guide, said relatively movable means arranged to move the secondary guide from an uppermost position to a lowermost position, a substantially horizontal reciprocable member connected with the elongated member and supporting the elongated member, motive means mounted by the horizontally reciprocable member for moving the secondary guide lengthwise of the elongated support member, a rotatable and reciprocable traverse means disposed adjacent the collector for converging the strands into a roving and distributing the roving lengthwise of the package, and means for laterally reciprocating the elongated support member and secondary guide in synchronism with the reciprocations of the traverse means.

2. Apparatus for packaging a roving comprised of a plurality of strands of fibers comprising, a primary strand guide having means separating the strands and maintaining the strands in spaced relation, a secondary strand guide engaging the strands below the primary guide, a winding apparatus including a rotating collector upon which the roving is wound into a package, an elongated support member disposed in substantial parallelism with the axis of movement of the strands toward the rotating collector, relatively movable chain means mounted by the elongated support member connected with the secondary guide, said relatively movable chain means arranged to move the secondary guide from an uppermost position to a lowermost position approaching the rotating collector, reciprocable tubular means connected with the elongated member and supporting the elongated member, motive means mounted by the reciprocable tubular means driving the chain means for moving the secondary guide lengthwise of the elongated support member, a rotatable and reciprocable spiral wire traverse means disposed adjacent the package collector for converging the strands into a roving and distributing the roving lengthwise of the package, and means for reciprocating the elongated support member and secondary guide in synchronism with the reciprocations of the traverse means.

3. Apparatus for packaging a roving comprised of a plurality of strands of fibers comprising, a primary strand guide having means separating the strands and maintaining the strands in spaced relation, a secondary strand guide engaging the strands below the primary guide, a winding apparatus including a rotating collector upon which the roving is wound into a package, an elongated support member disposed in substantial parallelism with the sxis of movement of the strands toward the rotating collector, relatively movable chain means mounted by the elongated support member connected with the secondary guide, said relatively movable chain means arranged to move the secondary guide from an uppermost position to a lowermost position adjacent the rotating collector, reciprocable tubular means connected with the elongated member and supporting the elongated member, motive means mounted by the reciprocable tubular means for moving the secondary guide, said motive means being periodically operable for moving the secondary guide in successive incremental distances toward its lowermost position, a rotatable and reciprocable spiral wire traverse disposed adjacent the package collector for converging the strands into a roving and distributing the roving lengthwise of the package, and means for reciprocating the elongated support member and secondary guide laterally in synchronism with the reciprocations of the spiral wire traverse.

4. Apparatus for packaging a roving comprised of a plurality of strands of fibers comprising, a strand guide having means separating the strands and maintaining the strands in spaced relation, a winding apparatus including a collector, motive means for rotating the collector upon which the roving is wound into a package, an elongated tubular support member arranged in substantial parallelism with the axis of movement of the strands toward the rotating collector, an endless chain disposed within the elongated tubular support member, sprockets journaled at the end regions of the elongated tubular support member, the endless chain engaging the sprockets, means for driving one of said sprockets, a horizontally disposed tubular member having an end region secured to the elongated support member and supporting the elongated support member, said horizontally disposed tubular member being mounted by the winding apparatus for lengthwise reciprocation, means connected with the endless chain supporting the strand guide, the endless chain being arranged to move the guide from an uppermost position to a lowermost position toward the rotating collector, means for reciprocating the horizontal tubular support member and the elongated tubular support and the strand guide, a rotatable and reciprocable traverse means disposed adjacent the package collector for converging the strands into a roving and distributing the roving lengthwise of the package, and means for reciprocating the traverse member in substantial synchronism with the reciprocations of the strand guide during a package winding operation.

5. Apparatus for packaging a roving comprised of a plurality of strands of fibers comprising, a strand guide having means separating the strands and maintaining the strands in spaced relation, a winding apparatus including a collector, motive means for rotating the collector upon which the roving is wound into a package, an elongated tubular support member arranged in substantial parallelism with the axis of movement of the strands toward the rotating collector, a first endless chain disposed within the elongated tubular support member, sprockets journaled at the end regions of the elongated tubular support member, the first endless chain engaging the sprockets, a second endless chain driving one of said sprockets, a horizontally disposed tubular member having an end region secured to the elongated support member and supporting the elongated support member, said horizontally disposed tubular member being mounted by the winding apparatus for lengthwise reciprocation, a shaft within said horizontal tubular member for driving the second endless chain, motive means for rotating said shaft for driving the first and second endless chains, means connected with the first endless chain supporting the strand guide, said first endless chain being arranged to move the guide from an uppermost position to a lowermost position, a first synchronous motor for reciprocating the horizontal tubular support and the elongated tubular support and the strand guide, a rotatable and reciprocable traverse means disposed adjacent the package collector for converging the strands into a roving and distributing the roving lengthwise of the package, and a second synchronous motor for reciprocating the traverse member, said synchronous motors being arranged to simultaneously reciprocate the strand guide and the traverse member in substantial synchronism during a package winding operation.

6. Apparatus for packaging a roving comprised of a plurality of strands of fibers comprising, a primary guide having means separating the strands and maintaining the strands in spaced relation, a secondary strand guide below the primary guide engaged by the strands, a winding apparatus including a rotating collector, motive means for rotating the collector upon which the roving is wound into a package, an elongated tubular member arranged in substantial parallelism with the axis of movement of the strands toward the rotating collector, a first endless chain disposed within the elongated support member, sprockets journaled at the end regions of the elongated tubular support member, the first endless chain engaging the sprockets, a second endless chain driving one of said sprockets, a horizontally disposed tubular member having an end region secured to the elongated support member and supporting the elongated support member, said horizontally disposed tubular member being mounted by the winding apparatus for lengthwise reciprocation, a shaft within said horizontal tubular member for driving the second endless chain, motive means for rotating said shaft for driving the first and second endless chains, means connected with the first endless chain supporting the secondary strand guide, said first endless chain being arranged to move the secondary guide from an uppermost position to a lowermost position, a first synchronous motor for reciprocating the horizontal tubular support and the elongated tubular support and the secondary strand guide, a rotatable and reciprocable spiral wire traverse means disposed adjacent the package collector for converging the strands into a roving and distributing the roving lengthwise of the package, and a second synchronous motor for reciprocating the traverse member, said synchronous motors being arranged to simultaneously reciprocate the secondary strand guide and the traverse member in substantial synchronism during a package winding operation.

7. Apparatus for simultaneously packaging rovings wherein each roving comprises a plurality of strands of fibers comprising; a plurality of primary guides having means separating the strands into a plurality of groups, the primary guides having means spacing the strands of each of the groups, a plurality of secondary guides adapted to be engaged with the groups of strands below the primary guides, a winding apparatus including a rotatable collector upon which the rovings are adapted to be wound into packages, motive means for rotating the collector, an elongated tubular support member arranged in substantial parallelism with the axis of movement of the groups of strands toward the rotating collector, a first endless chain disposed within the elongated tubular support member, first and second sprockets journaled at the end regions of the elongated tubular support member engaged by the first endless chain, a third sprocket associated with one of the first or second sprockets, a second endless chain engaging the third sprocket for driving the first endless chain, means mounted by the first endless chain supporting the plurality of secondary guides, the first endless chain being adapted to move the plurality of secondary guides from an uppermost position to a lowermost position during winding operations, a horizontally disposed tubular member having an end region secured to and supporting the elongated tubular support member, said horizontal tubular member being mounted by the winding apparatus for lengthwise reciprocation, a shaft within the horizontal tubular member equipped with a fourth sprocket engaging the second chain, a motor for rotating said shaft for driving the chains, a first synchronous motor for laterally reciprocating the horizontal tubular support member and the elongated tubular support member and the secondary strand guides, a plurality of rotatable and reciprocable spiral wire traverse members disposed adjacent the package collector for converging the groups of strands into rovings and distributing the rovings lengthwise of the packages being wound, and a second synchronous motor for reciprocating the traverse members, said synchronous motors being arranged to simultaneously reciprocate the secondary strand guides and the traverse members in substantial synchronism during package winding operations.

8. Apparatus for simultaneously producing and packaging rovings of strands of glass filaments wherein the filaments are formed by attenuating streams of heat-softened glass comprising; two primary guides engaging strands of glass filaments and separating the strands into two groups, the primary guides having means spacing the strands of each of the groups, two secondary guides adapted to be engaged with the respective groups of strands below the primary guides, a winding apparatus including a rotatable collector upon which two rovings are adapted to be wound into separate packages, motive means for rotating the collector, an elongated tubular support member arranged in substantial parallelism with the axis of movement of the strands toward the rotating collector, a first endless chain disposed within the elongated tubular support member, first and second sprockets journaled at the end regions of the elongated tubular support member engaged by the first endless chain, a third sprocket associated with one of the first or second sprockets, a second endless chain engaging the third sprocket for driving the first endless chain, means secured to the first endless chain supporting the two secondary guides, the first endless chain being adapted to move the secondary guides from an uppermost position to a lowermost position during winding operations, a horizontally disposed tubular member having an end region secured to and supporting the elongated tubular support member, said horizontal tubular member being mounted by the winding apparatus for lengthwise reciprocation, a shaft within the horizontal tubular member equipped with a fourth sprocket engaging the second chain, a motor for rotating said shaft for driving the chains, a first synchronous motor for laterally reciprocating the horizontal tubular support member and the elongated tubular support member and the secondary strand guides, a pair of rotatable and reciprocable spiral wire traverse members disposed adjacent the package collector for converging the two groups of strands into two rovings and distributing the two rovings lengthwise of the packages being wound, and a second synchronous motor for reciprocating the traverse members, said synchronous motors being arranged to simultaneously reciprocate the secondary strand guides and the spiral wire traverse members in substantial synchronism during package winding operations.

* * * * *